US006174123B1

(12) United States Patent
Marttila

(10) Patent No.: US 6,174,123 B1
(45) Date of Patent: Jan. 16, 2001

(54) GRIPPING DEVICE FOR POSITIONING SHEET-LIKE OBJECTS

(75) Inventor: Tom Marttila, Kirkkonummi (FI)

(73) Assignee: Outokumpu Oyj, Espoo (FI)

( * ) Notice: Under 35 U.S.C. 154(b), the term of this patent shall be extended for 0 days.

(21) Appl. No.: 09/403,810

(22) PCT Filed: Apr. 27, 1998

(86) PCT No.: PCT/FI98/00367

§ 371 Date: Oct. 25, 1999

§ 102(e) Date: Oct. 25, 1999

(87) PCT Pub. No.: WO98/49372

PCT Pub. Date: Nov. 5, 1998

(30) Foreign Application Priority Data

Apr. 29, 1997 (FI) ..... 971817

(51) Int. Cl.[7] ..... C25C 7/00; B66C 13/08
(52) U.S. Cl. ..... 414/626; 204/198
(58) Field of Search ..... 414/626; 118/425; 204/198, 225

(56) References Cited

U.S. PATENT DOCUMENTS 4,248,353 * 2/1981 Budzich et al. ..... 118/425 X
4,326,937 4/1982 Neumeier et al. .
5,151,006 9/1992 Marttila et al. .
5,568,720 * 10/1996 Teich et al. ..... 414/626 X

FOREIGN PATENT DOCUMENTS 0 679 735 11/1995 (EP) .
2190653 * 11/1987 (GB) ..... 414/426

* cited by examiner

*Primary Examiner*—Steven A. Bratlie
(74) *Attorney, Agent, or Firm*—Smith-Hill and Bedell

(57) ABSTRACT

Apparatus for transferring sheet-like objects from one position to another comprises a control frame including a vertical control member and a gripping device within the control frame and including a control member counterpart engaging the vertical control member of the control frame in a manner permitting relative movement of the control frame and the gripping device over a predetermined vertical range. A loading member is coupled to the gripping device for lowering the gripping device from an upper position to a lower position and for raising the gripping device from the lower position to the upper position, and a positioning member is attached to the gripping device for engaging a complementary member when the gripping device is at the lower position. When the gripping device is in the upper position the control frame is suspended from the gripping device and when the gripping device is lowered from the upper position to the lower position the control frame remains suspended from the gripping device until the control frame attains the lower position, whereupon downward movement of the control frame ceases and the gripping device continues downward movement relative to the control frame and the positioning member engages the complementary member.

9 Claims, 4 Drawing Sheets

GRIPPING DEVICE FOR POSITIONING SHEET-LIKE OBJECTS

BACKGROUND OF THE INVENTION

Figure 1:
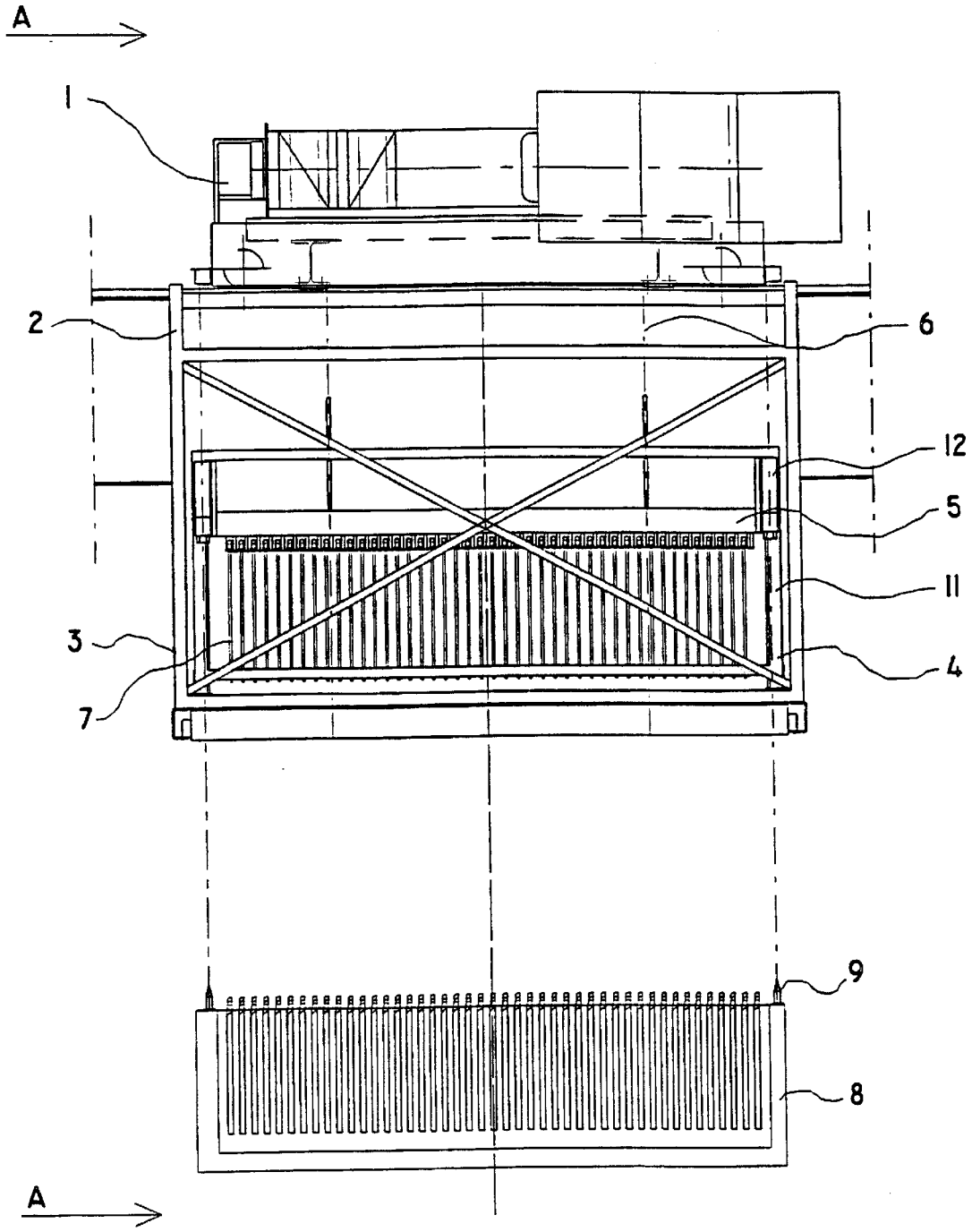

The present invention relates to a mechanically positioned gripping device which is used in the transfer arrangements of sheet-like objects, such as electrodes needed in electrolysis, for transferring objects from one position to another.

During electrolysis, metal is precipitated, by means of electric current, onto the surface of an electrode serving as the cathode. In order to perform the precipitation in an advantageous manner, the electrodes, i.e. the anode and the cathode, should be positioned as near to each other as possible. In large electrolytic tanks, the anodes and cathodes are placed in an alternating fashion. When electrodes must be replaced, for instance in order to recover a precipitate created on the cathode, the replacement is carried out by means of an automatic charging machine which first removes from the tank a desired number of electrodes, such as cathodes, and replaces them with the same number of electrodes. Now, in order to avoid shortcircuits, the charging machine and particularly the gripping device provided in the charging machine must be arranged in an advantageous position with respect to the electrodes for preventing any contact between the electrodes, i.e. the anode and the cathode. In order to avoid said contact, there are designed various different devices utilizing either members attached to the electrolytic tank itself or to a transfer device, said members attempting to adjust the gripping device in an advantageous position.

From the DE patent application Ser. No. 3,508,195, there is known a device where the target of positioning is provided with mechanical guide cones which perform the precise positioning while the gripping device is lowered down. The precise positioning motion takes place on sliding or rolling surfaces that also support the load and the gripping device. Due to this structure, the loading machinery of the transfer arrangement obtains a remarkably bigger loading than the load and the gripping device as such.

In an apparatus according to the Fl patent application No. 870,285, the loading member is provided with a stationary conduit, along which a separate housing moves, supported by the loading machinery. The gripping device is suspended from this housing by means of turnbuckles, and the gripping device is moved in relation to the housing in order to achieve a precise positioning. The separate housing causes an extra load for the loading machinery. The turnbuckles participate in supporting the load and the gripping device, wherefore they must be essentially stronger. Owing to their location, the turnbuckles are short, and the shortening of the turnbuckles in turn leads to worse and worse height alterations and inclinations caused by the positioning movements in connection with the turnbuckle suspension. In the apparatus according to the Fl patent application No. 870,285, said height alterations, and inclinations are directly focused to the gripping device and the load, wherefore the play of positioning remains essentially shorter, and an essentially advanced positioning accuracy is required of the loading member.

From the Fl patent No. 82,435, there is known an automatic charging member for positioning anodes and cathodes in electrolytic tanks. The charging member is provided with members for charging and gripping the load, and with a control frame installed in between the loading member and the gripping device, as well as position sensors for positioning the load. By means of the position sensors, the location of position signs installed in the electrolytic tanks is detected, so that on the basis of the information obtained from the position sensors, the positioning of the gripping device is carried out by moving the control frame. However, the use of position sensors is not possible in all applications.

Moreover, the publications referred to in the above specification do not at all describe how the electrodes immersed in the electrolytic tank are loaded from the electrode handling machine to the transfer system.

SUMMARY OF THE INVENTION

The object of the present invention is to eliminate some of the drawbacks of the prior art and to achieve an improved and more feasible, mechanically positioned gripping device that can be used for moving sheet-like objects, such as anodes and cathodes needed in electrolysis, from one position to another, so that by means of the transfer apparatus, the gripping device can be maintained in an advantageous position with respect to the electrodes to be loaded.

The transfer apparatus for sheet-like objects, including the gripping device according to the invention, comprises a loading member, a control frame and a gripping device; members connected to the loading member and designed for moving the control frame and the gripping device in an essentially vertical direction, as well as members for moving the loading member and for performing the transferring of the sheet-like objects from one position to another. In the loading member, there can be permanently attached a protecting member that prevents the control frame, the gripping device and the transferable load suspended from the gripping device from moving essentially in the horizontal direction during transfer. During the transfer, the loading member moves from one position to another and supports the transferable load composed of sheet-like objects, as well as other members of the transfer system.

The gripping device according to the invention is installed so that it is movable in an essentially vertical direction with respect to both the loading member and the control frame. The gripping device is connected to the loading member by means of at least one essentially vertically movable moving member, so the the gripping device is movable essentially vertically also with respect to the control frame. The control frame is advantageously connected to the loading member by means of a moving member that the control frame and the gripping device have in common. The control frame can also be connected to the loading member by means of at least one moving member that is separate from the gripping device and moves in an essentially vertical direction. The gripping device according to the invention is further arranged, in relation to the control frame, so that it is movable in an essentially vertical direction by means of at least one control member connected to the control frame and one control member counterpart connected to the gripping device. The control member can also be arranged in the gripping device, in which case the counterpart of the control member must be installed in the control frame.

The gripping device according to the invention and the control frame connected thereto by intermediation of the control member are both provided with at least one positioning member in order to position the gripping device with respect to the loading or unloading position of the load under transfer. Advantageously the positioning member is arranged in the gripping device so that the positioning member of the gripping device can be arranged, with the control frame positioning member, in the same position member connected to the unloading and loading position of the load under transfer. Thus the gripping device can be rendered essentially immovable with respect to the control frame in the unloading and loading position of the load under transfer, and it can also be locked in the unloading and loading position.

The positioning member of the gripping device according to the invention can also be installed in the gripping device so that the positioning member of the gripping device is either arranged, with respect to the positioning member of the control frame, in a separate positioning member connected to the unloading and loading position of the load under transfer, or it can be left unlocked with respect to the unloading and loading position. Even if the gripping device itself is left unlocked in the unloading and loading position, it is important from the point of view of the gripping device according to the invention that the control frame connected to the gripping device by intermediation of the control member is positioned in the unloading and loading positioning by means of the positioning member. In that case the control frame can advantageously be provided with at least two positioning members that are used either simultaneously or separately. Accordingly, as the control frame is positioned in the unloading and loading position, the gripping device can be moved, when necessary, for instance in the unloading and loading position in connection with an electrode handling machine in an essentially horizontal direction, within the scope allowed by the clearance left in between the control member, installed in between the control frame and the gripping device, and by the control member counterpart.

By employing the gripping device according to the invention, the transferring of sheet-like objects in between the unloading and loading positions, for instance the transferring of electrodes from electrolytic tanks to electrode handling machines and vice versa, can be essentially speeded up; it also is possible to improve the positioning accuracy of electrodes in electrolytic tanks, to reduce the risk of damage to for electrodes and electrolytic tanks and to reduce the personnel required in the transfer of electrodes.

The gripping device according to the invention can advantageously be used together with an automatically positioned, either fully automatic or ground-controlled transfer system. Now the electrodes can be raised and lowered essentially precisely by using the gripping device, without a person who assists and controls the operation of said gripping device.

BRIEF DESCRIPTION OF THE INVENTION

Figure 2:
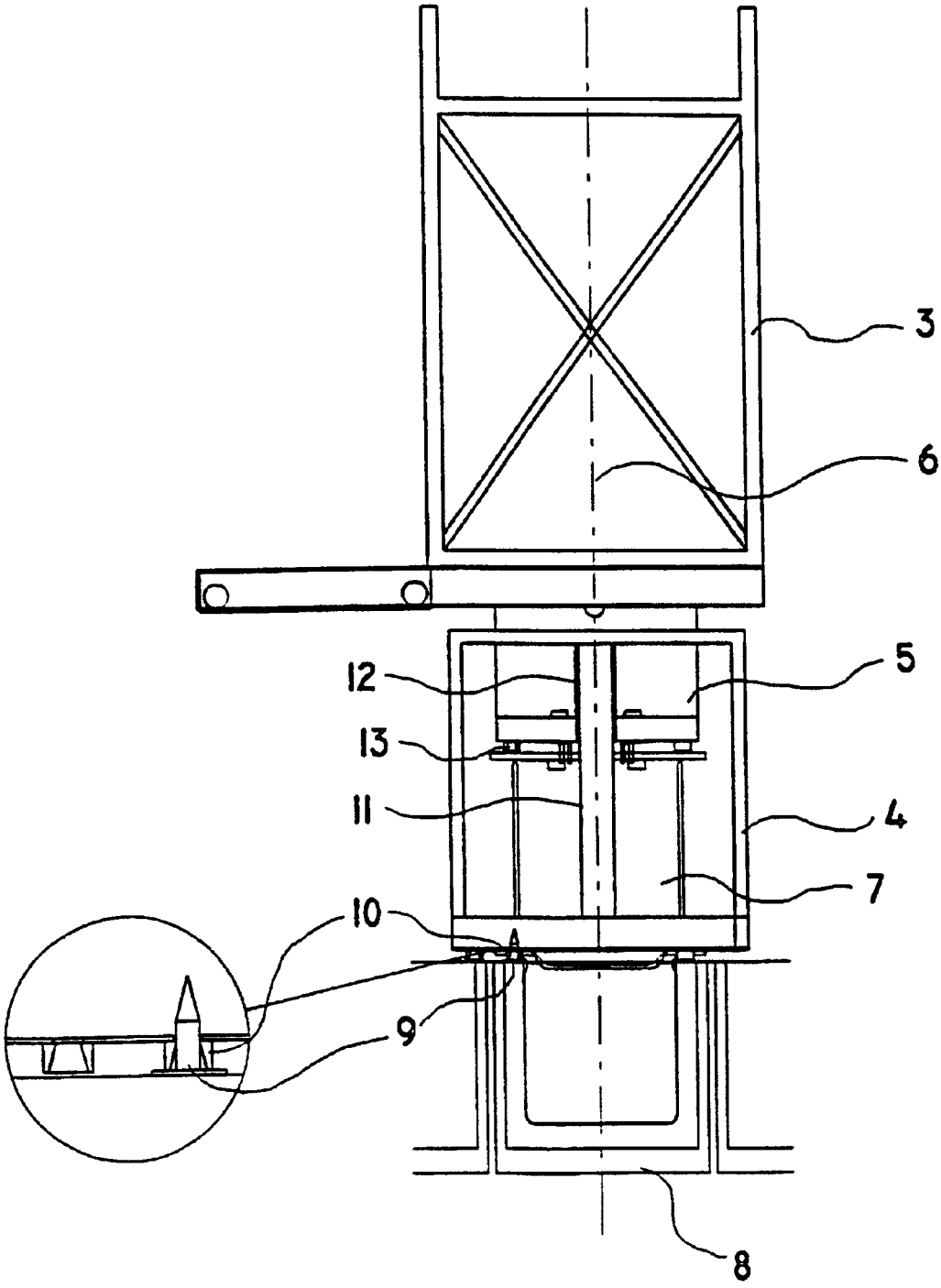
Figure 3:
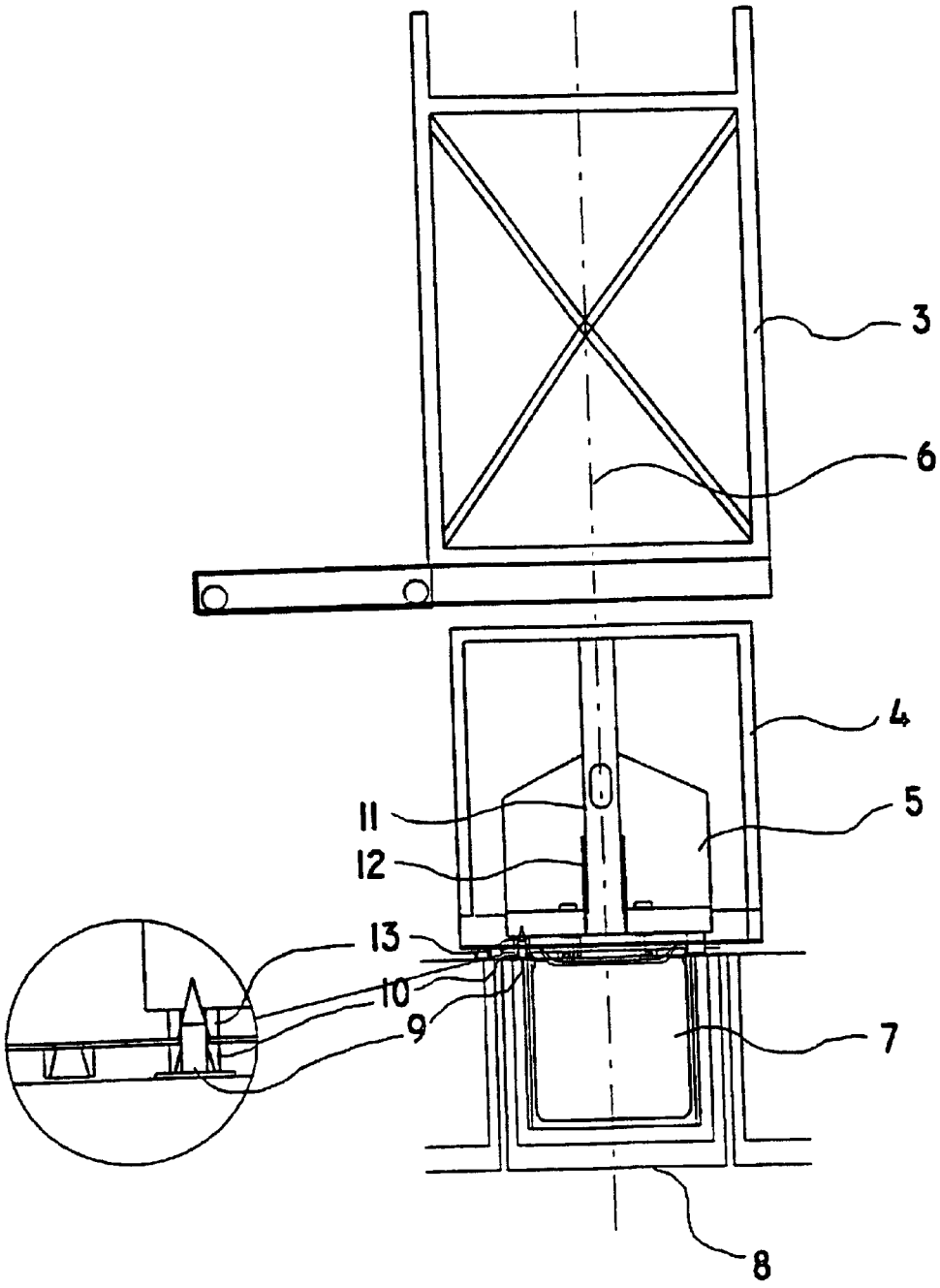
Figure 4:
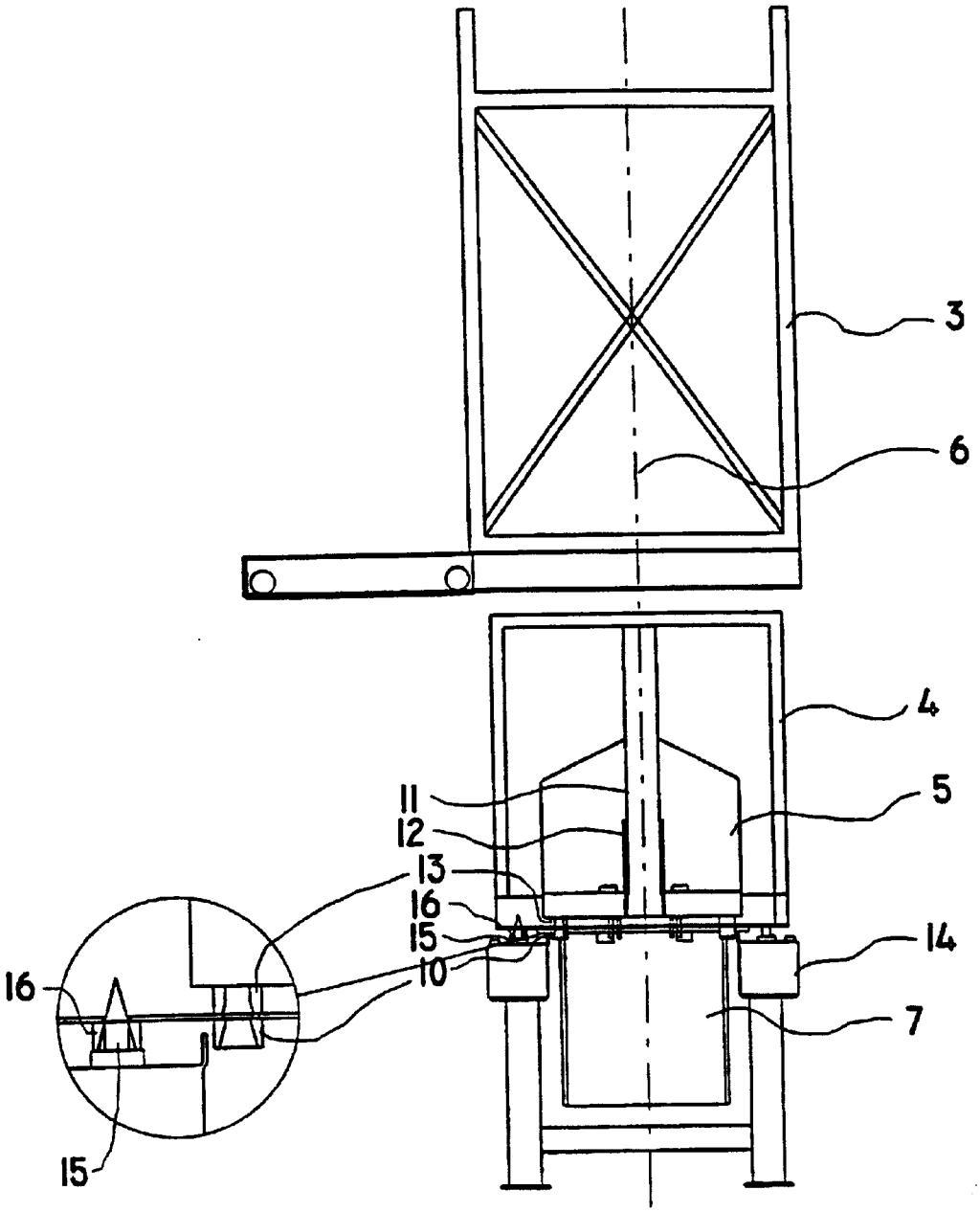

The invention is explained in more detail with reference to the appended drawing, where FIG. 1 is a schematical side-view illustration of a preferred embodiment of the invention, when the transfer apparatus is at .the electrolytic tank ready to unload, FIG. 2 illustrates the embodiment of FIG. 1, seen from the direction A—A, when the control frame is positioned at the electrolytic tank, FIG. 3 illustrates the embodiment of FIG. 1, seen from the direction A—A, when the gripping device is positioned at the electrolytic tank, and FIG. 4 illustrates the embodiment of FIG. 1, when the gripping device is positioned at the electrode handling machine.

DETAILED DESCRIPTION OF THE INVENTION

The loading member 1 of the transfer apparatus according to FIGS. 1, 2 and 3 supports, by means of a support member 2, a protecting member 3 containing the control frame 4 and the gripping device 5. The gripping device 5 is suspended, by means of a moving member 6, from the loading member 1. The control frame 4 includes control members 11 which are engaged by counterparts 12 connected to the gripping device 5. The gripping device is movable vertically relative to the control frame 4, guided by engagement of the counterparts 12 with the control members 11. Clearance between the control members 11 and the counterparts 12 allows the gripping device to move horizontally relative to the control frame. The gripping device 5 further supports the control frame 4 and the electrodes 7 locked in the gripping device 5. In order to immerse the electrodes 7 in the electrolytic tank 8, the gripping device 5 is started to be lowered by means of the moving member 6. While lowering the gripping device 5, also the control frame 4 is lowered down. Because the structure of the control frame 4 is made to be such that the electrodes fit inside the control frame 4, the control frame 4 reaches the electrolytic tank 8 before the gripping device 5 during the lowering process. In the electrolytic tank 8, there are provided positioning pins 9, which engage positioning sleeves 10, located in the bottom part of the control frame 4, while lowering the control frame 4, so that the control frame 4 is positioned in relation to the electrolytic tank 8.

When the downward motion of the control frame 4 stops, the gripping device 5 begins to descend in the direction defined by the control members 11 provided in the control frame 4 and the counterparts 12 connected to the gripping device 5. The gripping device 5 also is provided with positioning sleeves 13, which are engaged by the positioning pins 9 installed in the electrolytic tank 8 when the gripping device 5 approaches the electrolytic tank 8. The control frame 4 and the gripping device 5 are thus mutually positioned in the same place, so that the load, i.e. the electrodes 7, to be lowered in connection with the positioning thereof, is advantageously immersed in the electrolytic tank 8. When the electrodes 7 are in the electrolytic tank 8 suspended from the respective support members, the locking of the gripping device 5 is unlocked, and the gripping device 5 is started to be raised to its top position, in which case also the control frame 4 begins to rise as the counterparts 12 provided in the gripping device 5 reach the top part of the control members 11 installed in the control frame 4.

According to FIG. 4, the control frame 4 and the gripping device 5 are positioned in the electrode handling machine 14 in order to load the electrodes 7 to be transferred to the electrolytic tank 8. The gripping device 5 and the control frame 4 are positioned in the electrode handling machine 14 by means of position pins 15 located in the electrode handling machine by using position sleeves 16 provided on the exterior surface of the control frame 4. Thus the gripping device 5 can be moved essentially horizontally with respect to the control frame 4 within the range determined by the clearance left between the control member 11 and the control member counterpart 12. Consequently, any electrodes 7 placed in an incorrect position in the electrode handling machine 14 with respect to the control frame 4 are advantageously locked in the correct position in relation to the gripping device 5.

What is claimed is:

1. Apparatus for transferring sheet-like objects from one position to another, the apparatus comprising:

a control frame including at least one vertical control member, a gripping device within the control frame and including at least one control member counterpart engaging the vertical control member of the control frame in a manner permitting relative movement of the control frame and the gripping device over a predetermined vertical range, a loading member coupled to the gripping device for lowering the gripping device from an upper position to a lower position and for raising the gripping device from the lower position to the upper position, and a positioning member attached to the gripping device for engaging a complementary member when the gripping device is at the lower position, and wherein when the gripping device is in the upper position the control frame is suspended from the gripping device and when the gripping device is lowered from the upper position to the lower position the control frame remains suspended from the gripping device until the control frame attains the lower position, whereupon downward movement of the control frame ceases and the gripping device continues downward movement relative to the control frame and the positioning member engages the complementary member.

2. Apparatus according to claim 1, comprising a positioning member attached to the control frame for engaging a complementary member when the control frame is at the lower position.

3. Apparatus according to claim 1, comprising a positioning member attached to the control frame for engaging said complementary member when the control frame is at the lower position.

4. Apparatus according to claim 1, comprising first and second positioning members attached to the control frame for engaging first and second complementary members respectively.

5. Apparatus for processing sheet-like objects, the apparatus comprising a first means defining a first processing station, a second means defining a second processing station, a mechanism for transferring sheet-like objects from the first processing station to the second processing station, and a transporting means for transporting the mechanism from the first station to the second station, wherein the first means includes a first complementary member at the first processing station and the mechanism comprises:

a control frame including at least one vertical control member, a gripping device within the control frame and including at least one control member counterpart engaging the vertical control member of the control frame in a manner permitting relative movement of the control frame and the gripping device over a predetermined vertical range, a loading member coupled to the gripping device for lowering the gripping device from an upper position to a lower position and for raising the gripping device from the lower position to the upper position, and a positioning member attached to the gripping device for engaging the first complementary member when the gripping device is at the lower position, and wherein when the mechanism is at the first station and the gripping device is in the upper position the control frame is suspended from the gripping device and when the gripping device is lowered from the upper position to the lower position the control frame remains suspended from the gripping device until the control frame attains the lower position, whereupon downward movement of the control frame ceases and the gripping device continues downward movement relative to the control frame and the positioning member engages the first complementary member.

6. Apparatus according to claim 5, wherein the mechanism includes a positioning member attached to the control frame for engaging a complementary member when the control frame is at the lower position, the second means includes a second complementary member at the second processing station, and the positioning member attached to the control frame engages the second complementary member when the mechanism is at the second processing station and the control frame is at the lower position.

7. Apparatus according to claim 5, wherein the control frame is provided with a positioning member for engaging a complementary member when the control frame is at the lower position, whereby the positioning member attached to the control frame engages the first complementary member when the mechanism is at the first processing station and the gripping device is at the lower position.

8. Apparatus according to claim 7, wherein the first complementary member is a pin and the positioning members attached to the gripping device and the control frame are sockets.

9. Apparatus according to claim 5, wherein the mechanism includes first and second positioning members attached to the control frame for engaging respective complementary members when the control-frame is at the lower position, the second means includes a second complementary member at the second processing station, and the first positioning member engages the first complementary member when the mechanism is at the first processing station and the control frame is at the lower position and the second positioning member engages the second complementary member when the mechanism is at the second processing station and the control frame is at the lower position.

* * * * *